US005642954A

United States Patent [19]

Hudspith

[11] Patent Number: 5,642,954

[45] Date of Patent: Jul. 1, 1997

[54] SPACE-SAVING COLLAPSIBLE RING BINDER

[75] Inventor: Sydney Hudspith, Glendale, Calif.

[73] Assignee: Avery Dennison Corporation, Pasadena, Calif.

[21] Appl. No.: 648,413

[22] Filed: May 15, 1996

[51] Int. Cl.[6] ..... B42F 3/04

[52] U.S. Cl. ..... 402/36; 402/26; 402/80 K

[58] Field of Search ..... 402/26, 28, 29, 402/30, 31, 36, 42, 43, 46, 55, 56, 23, 20, 37, 80 R

[56] References Cited

U.S. PATENT DOCUMENTS

| | | | |
|---|---|---|---|
| 484,268 | 10/1892 | Westrup . | |
| 1,840,743 | 1/1932 | Schade . | |
| 2,093,041 | 9/1937 | Emery . | |
| 2,206,317 | 7/1940 | Behn . | |
| 2,832,348 | 4/1958 | Demarest . | |
| 3,331,373 | 7/1967 | Lohmeier . | |
| 3,748,051 | 7/1973 | Frank | 402/44 X |
| 3,927,949 | 12/1975 | Clinch | 402/22 |
| 4,127,340 | 11/1978 | Almgren | 402/44 |
| 4,180,341 | 12/1979 | Langhorst | 402/80 |
| 4,569,613 | 2/1986 | Thomas | 402/80 |
| 4,744,689 | 5/1988 | Sternberg | 402/70 X |
| 4,842,434 | 6/1989 | Ferreira-Godinho | 402/34 |
| 4,886,390 | 12/1989 | Silence et al. | 402/80 |
| 5,213,429 | 5/1993 | Johnson | 402/8 |
| 5,333,962 | 8/1994 | Johnson | 402/8 |
| 5,423,624 | 6/1995 | Richards | 402/13 |

*Primary Examiner*—Willmon Fridie, Jr.
*Attorney, Agent, or Firm*—Poms, Smith, Lande & Rose

[57] ABSTRACT

A space-saving ring binder is in a collapsed position when not in use, for example, during packing, shipping, storage, occupying shelf space, and in an upright position when in use retaining paper. The thickness of the ring binder is significantly less when in the collapsed position than when in the upright position. The ring binder includes a cover portion and a binding portion attached to the cover portion. The binding portion has a plurality of rings rotatably attached to a toggling assembly. The rings are pivotal from a collapsed position in which the rings define an acute angle with the toggling assembly to an upright position in which the rings are substantially perpendicular with the toggling assembly. The rings may be permanently locked in the upright position.

24 Claims, 6 Drawing Sheets

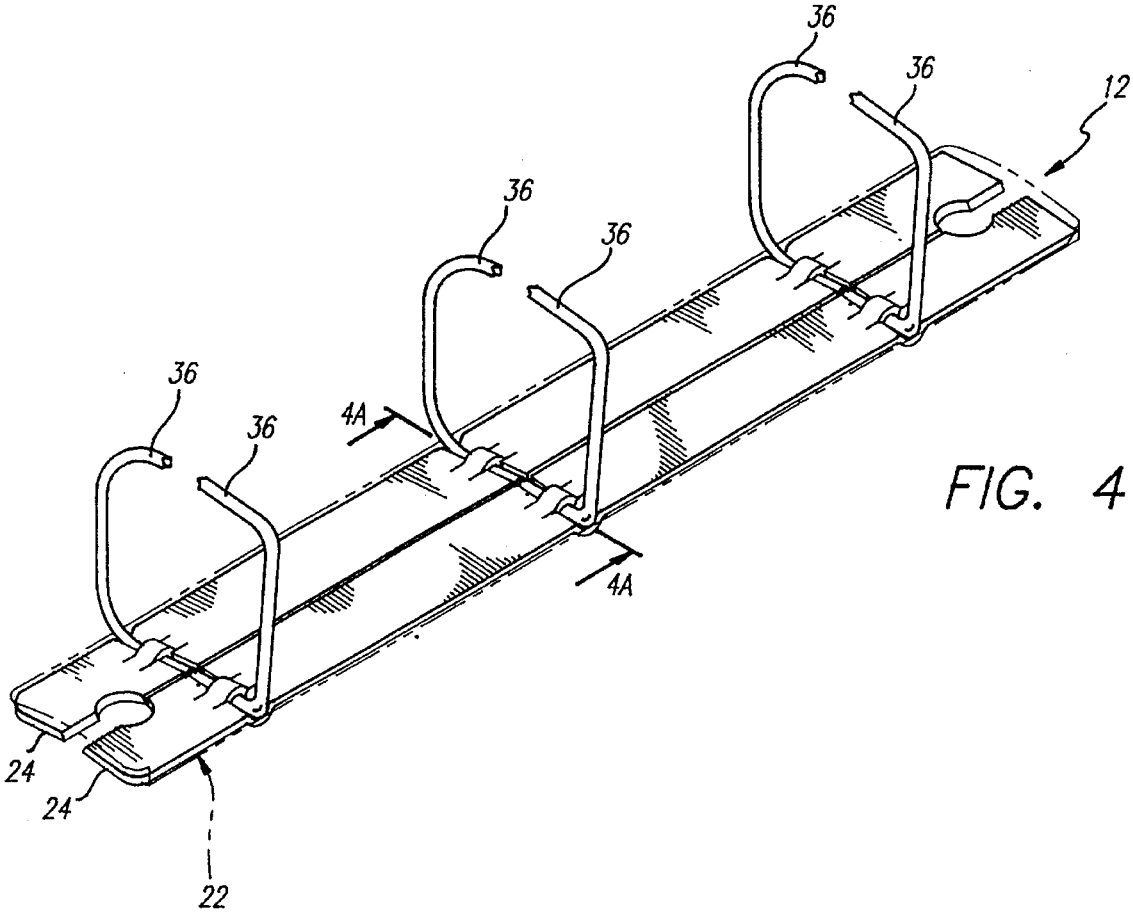
FIG. 4
FIG. 5
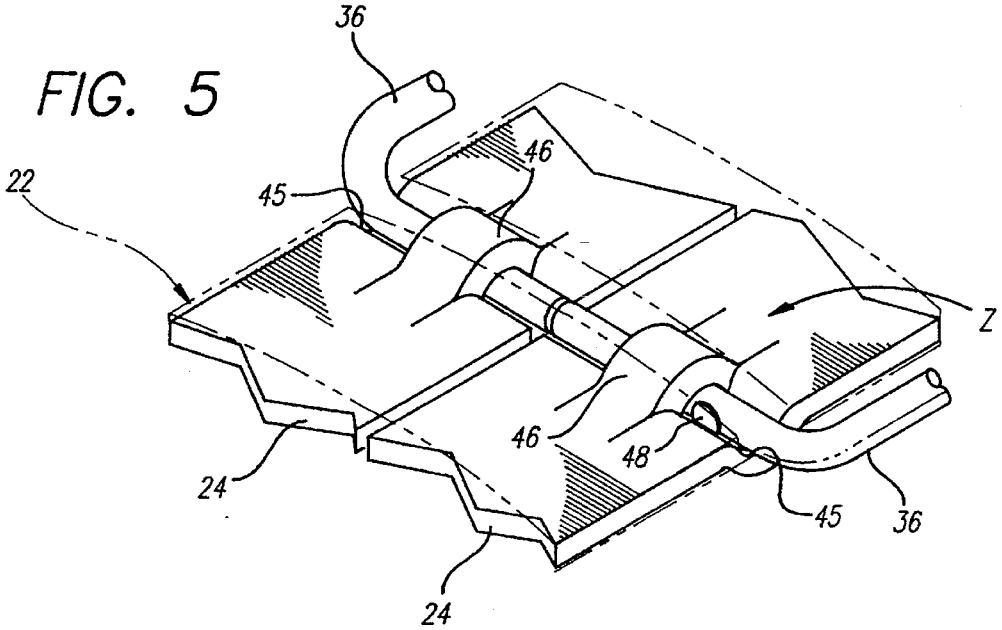

SPACE-SAVING COLLAPSIBLE RING BINDER

BACKGROUND OF THE INVENTION

1. Field of the Invention

The present invention relates to binders for papers and, more particularly, to binders which employ a plurality of rings to retain paper or the like.

2. Description of the Related Art

Ring binders are used extensively in business and industry, in educational institutions and government agencies, and in domestic households. Ring binders are convenient for semi-permanently retaining paper or the like, with the paper having holes punched in one of the margins. They are often used for filing and are easily labeled along the spine and come in various colors for easy recognition. They are conveniently dimensioned so as to fit in file cabinets and bookcases.

The most commonly used ring binder is the three-ring binder. However, ring binders employing two rings, five rings, and so on are also available. Oftentimes the number of rings and the spacing of the rings is customized for a particular application such as with promotional, sales, or instructional materials. Common ring binders retain paper with holes punched in the left margin with the pages being turned from right to left. Ring binders may also retain paper with holes punched in the top margin with the pages turned over the top.

The size of the ring binder (i.e., the diameter of the rings) and, accordingly, the amount of paper the ring binder is able to retain varies. For example, a small ring binder may have ½-inch diameter rings. An average sized ring binder may have 1-inch to 1½-inch diameter rings. A large ring binder, often provided with an articulated cover and rings with a flat portion, may have rings in the 3-inch diameter range. In addition, archival ring binders have ring diameters in the neighborhood of 5 inches.

One of drawbacks in the commercial trade of ring binders, including shipping, handling, storing, and wholesale and retail selling (particularly in terms of inventory and shelf space), is the size of the ring binders. Storage space is also a concern to stores or other users who buy and use large quantifies of large-ringed binders. For example, if a ring binder has 3-inch diameter rings, the overall thickness or depth of the binder when empty is about 3¼ inches to 3½ inches. Further, shipping companies often charge by volume and not by weight. Therefore, a ring binder which may not weigh much, relatively speaking, but which takes up a lot of space will have a relatively high per-unit shipping cost.

In an attempt to reduce the cost of shipping and storing, manufacturers of ring binders pack the binders into boxes in alternating directions to minimize shipping space. In doing this, the shipping space is reduced approximately in half. However, the required space is still much greater than the thickness of the binder covers.

In view of this drawback, it is an object of the present invention to reduce the costs associated with shipping and storing ring binders by providing a ring binder which occupies relatively little space during shipping, handling, and storage, and relatively little shelf space during wholesale and retail sales.

Another object of the present invention is to provide a collapsible ring binder which is able to be manufactured in an efficient and cost-effective manner so that the increase in the per-unit price to manufacture the collapsible binder does not exceed the per-unit savings in the shipping costs.

It is further object of the invention to provide ring binders which may be packed more densely into boxes for shipping, thereby saving paper, packing, and shipping costs.

SUMMARY OF THE INVENTION

According to one aspect of the present invention, a binding assembly for papers includes a cover portion and a binder portion. The cover portion has a front cover, a back cover, and a spine, with the front cover and the back cover being pivotally attached to the spine. The binder portion includes a plurality of rings for retaining paper or the like and a pivoting or toggling assembly attached to the cover portion for enabling the rings to pivot or toggle between an open position to receive paper and a closed position to retain paper. The rings are pivotally mounted to the toggling assembly and are pivotal between a collapsed position in which the rings define an acute angle with respect to the toggling assembly and a locked or stabilized upright position in which the rings are substantially perpendicular to the toggling assembly. The acute angle defined between the rings and the toggling assembly is preferably less than about 15 degrees, and the rings may lie substantially flat against the toggling assembly.

One advantage of the present invention is that the thickness of the binding assembly is greatly reduced when the binding assembly is in the collapsed position. For example, the thickness of the binding assembly when the rings are in the collapsed position is at least 50 percent less than the thickness of the binding assembly when the rings are in the upright position. If the rings have a relatively large diameter, for example, 5 inches, then this difference in thickness may be up to about 90 percent. Accordingly, many more binding assemblies of the present invention may be packed into a box for shipping than is possible with conventional non-collapsing binders. This saves on packing and shipping costs. Further, many more binding assemblies of the present invention may be stored on a shelf for retail sale, thereby saving on shelf space which is particularly beneficial to wholesalers and retailers of binding assemblies.

One of the features of the present invention is that a pull-tab may be provided so that the rings can be collectively pivoted from the collapsed position to the upright position at one time. The pull-tab may include a pull strip releasably attached to each of the rings and a finger ring attached to an end of the pull strip.

According to another aspect of the present invention, the toggling assembly of the binding assembly includes a pair of pivoting or toggling plates. A plurality of troughs, corresponding to the plurality of rings, may be formed in the toggling plates and rotatably receive one of the rings in each. A plurality of retaining straps may be also formed in the toggling plates each for retaining one of the rings in the corresponding trough. The troughs and the retaining straps may be formed by cutting a pair of longitudinally extending cuts in the toggling plates for each of the retaining straps. The toggling plates are then deformed or crimped downward at the pair of cuts to form the troughs and upward at the pair of cuts to form the retaining straps. This formation may easily take place on a single assembly line, thereby efficiently utilizing manufacturing costs.

Another feature of the binding assembly of the present invention is that the rings may be permanently or semipermanently locked in the upright position. In order to do this, each of the troughs may have a hole formed therein and each of the rings may have a boss formed thereon. Each of the bosses is receivable in one of the holes when the rings are in the upright position. The bosses may be spring activated so that a user can collapse the rings in the future if desired.

Other aspects, advantages, and features of the present invention will become apparent to those skilled in the art from a reading of the following detailed description with reference to the accompanying drawings.

BRIEF DESCRIPTION OF THE DRAWINGS

FIG. 4 is a perspective view of the binding portion, particularly showing the binding portion in an upright and open position;

FIG. 5 is a fragmentary perspective view of a binding portion of a ring binder in accordance with the present invention, particularly showing a pivotal attachment and locking structure of the binding portion in a collapsed position;

DETAILED DESCRIPTION OF THE PREFERRED EMBODIMENTS

With reference to the drawings, exemplary embodiments of a ring binder implemented in accordance with the principles of the present invention are illustrated. Provided hereunder is a detailed description of these exemplary embodiments. Those skilled in the art will realize numerous alternative embodiments and modifications from reading the detailed description with reference to the drawings. Such alternatives and modifications also fall within the principles of the present invention as defined in the accompanying claims.

Figure 1:
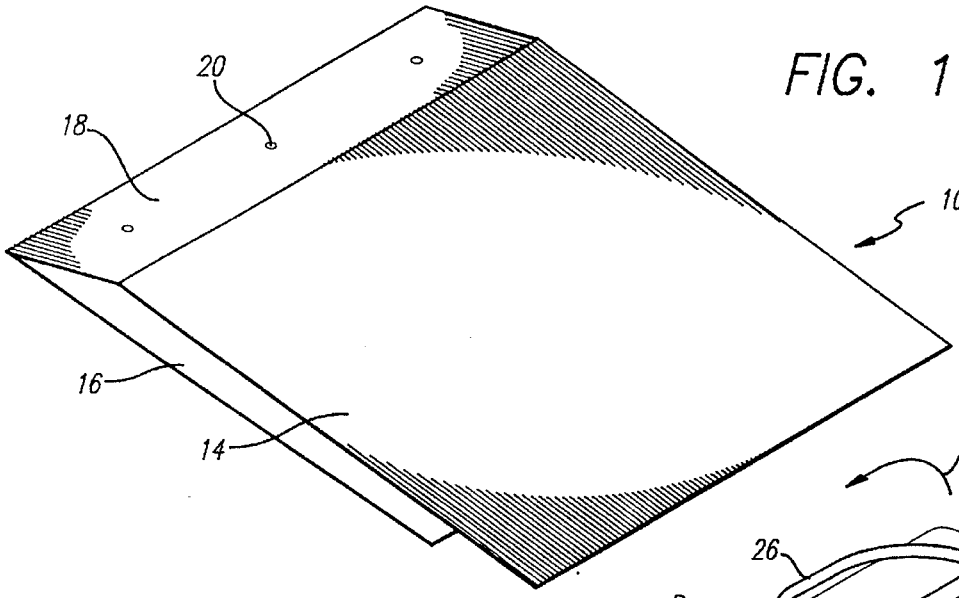
FIG. 1 is a perspective view of a ring binder in a stored or a collapsed position according to an exemplary embodiment of the present invention.
Figure 2:
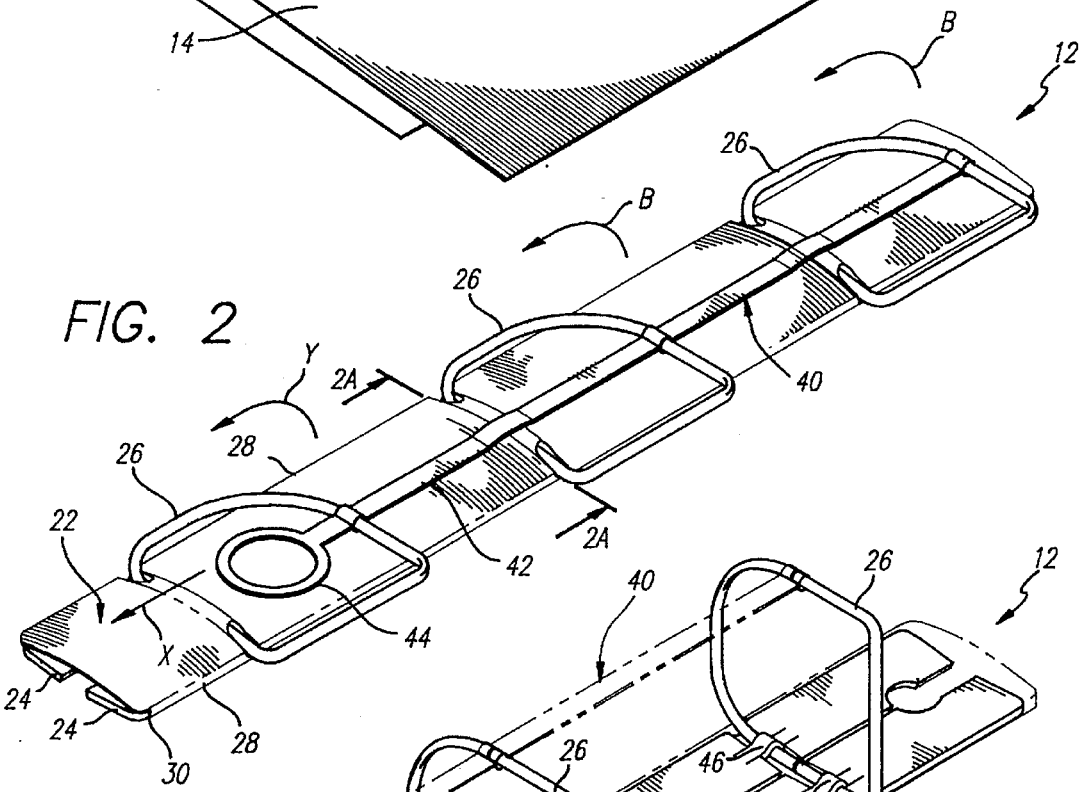
FIG. 2 is a perspective view of a binding portion of a ring binder in accordance with an exemplary embodiment of the present invention, particularly showing the binding portion in a collapsed position.

With reference to FIGS. 1 to 3A, an exemplary embodiment of a ring binder 10 for holding papers is shown in FIG. 1 in a stored or collapsed position. In FIG. 2, an exemplary embodiment of an enhanced binding assembly 12 is shown in a collapsed position, with a cross-sectional view thereof shown in FIG. 2A. The enhanced binding assembly 12 is shown in an upright position in FIG. 3, with a cross-sectional view thereof shown in FIG. 3A. The enhanced binding mechanism 12, when incorporated in the ring binder 10, allows the ring binder 10 to lay substantially flat when compared to conventional ring binders when not in use. This substantially reduces the amount of space required for packing, shipping, and storing, thereby reducing the costs associated with such business activities. Therefore, the ring binder 10 in accordance with the present invention is much more economical than conventional ring binders.

The ring binder 10 has a cover portion including a front cover 14, a back cover 16, and a spine 18 to which the covers 14 and 16 are pivotally attached along longitudinal edges thereof. The enhanced binding assembly 12 comprises the binding portion of the ring binder 10 and is attached to the cover portion, either the spine 18 or one of the covers 14 or 16, by fastening means Such as rivets 20. As clearly shown in FIG. 1, when the enhanced binding assembly 12 is in a collapsed position, the ring binder 10 lays relatively flat with the spine 18 folding over toward the back cover 16 (or, alternatively, toward the front cover 14) to define a relatively small acute angle between the back cover 16 and the spine 18 and a relatively large obtuse angle between the front cover 14 and the spine 18. Accordingly, the overall thickness of the ring binder 10 is relatively small and only slightly greater than the thickness of the enhanced binding assembly 12 itself in the collapsed position.

Figure 4A:
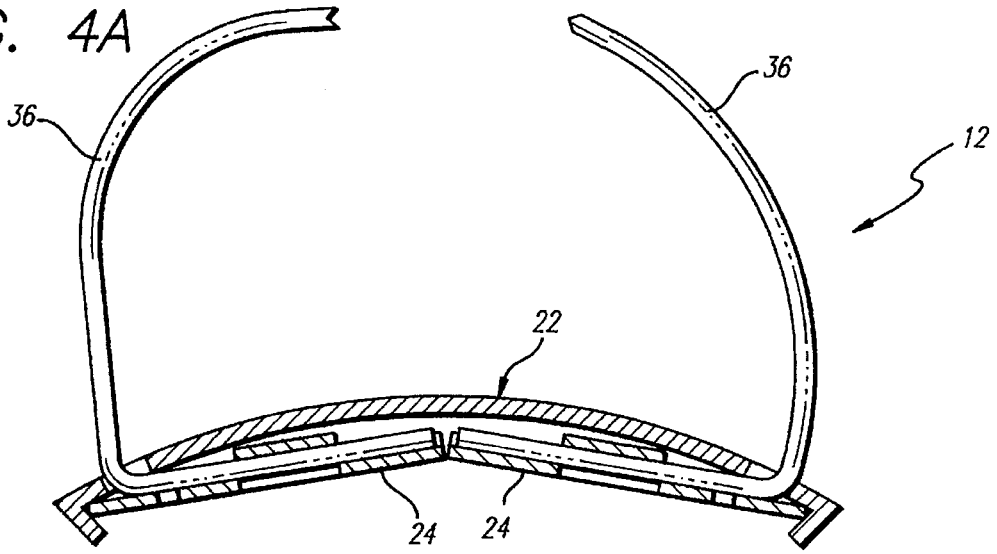
FIG. 4A is a cross-sectional view of the upright and open binding portion taken along line 4A—4A of FIG. 4.

With additional reference to FIGS. 4 and 4A, the binding assembly 12 according to the present invention generally includes a cover plate 22, a pair of pivotally coupled toggling plates 24, and a plurality of rings 26. The cover plate 22 has a pair of longitudinal edges 28. A channel 30 is formed along each of the longitudinal edges 28 of the cover plate 22 by, for example, folding the edges 28 through an angle of greater than 90 degrees. Alternative methods as known in the art for forming the channels 30 may also be used. The channels 30 have a transverse distance defined therebetween, and the cover plate 22 is preferably arched, arcuate, or curvilinear between the channels 30.

Each of the pivoting or toggling plates 24 has an inner longitudinal edge 32 and an outer longitudinal edge 34. The inner longitudinal edges 32 of the toggling plates 24 are configured to pivotally cooperated with each other. For example, the inner edges 32 may be crimped together to form a crimped joint at which the toggling plates 24 are centrally pivotal with respect to each other. The toggling plates 24 are disposed within the cover plate 22 with the outer longitudinal edges 34 received within the longitudinal channels 30 of the cover plate 22. Alternatively, the toggling plates 24 may have complementarily and pivotally configured tongue-and-groove arrangements formed on the inner longitudinal edges 2 which allow the toggling plates 24 to centrally pivot with respect to each other.

Figure 3:
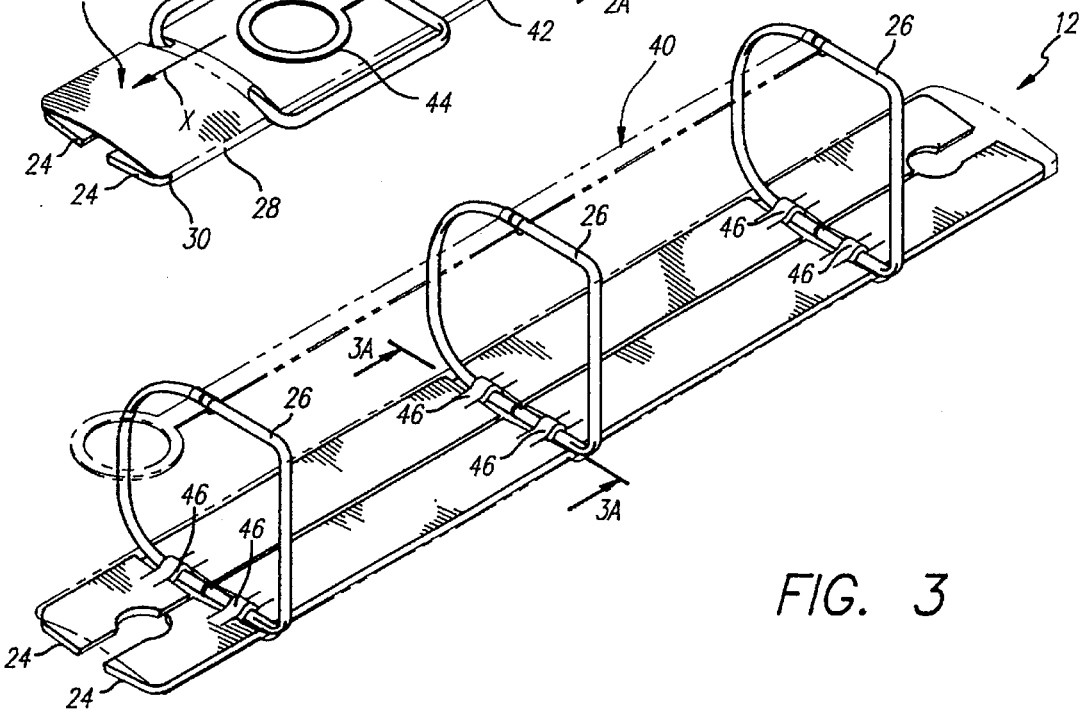
FIG. 3 is a perspective view of the binding portion, particularly showing the binding portion in an upright and closed position.
Figure 3A:
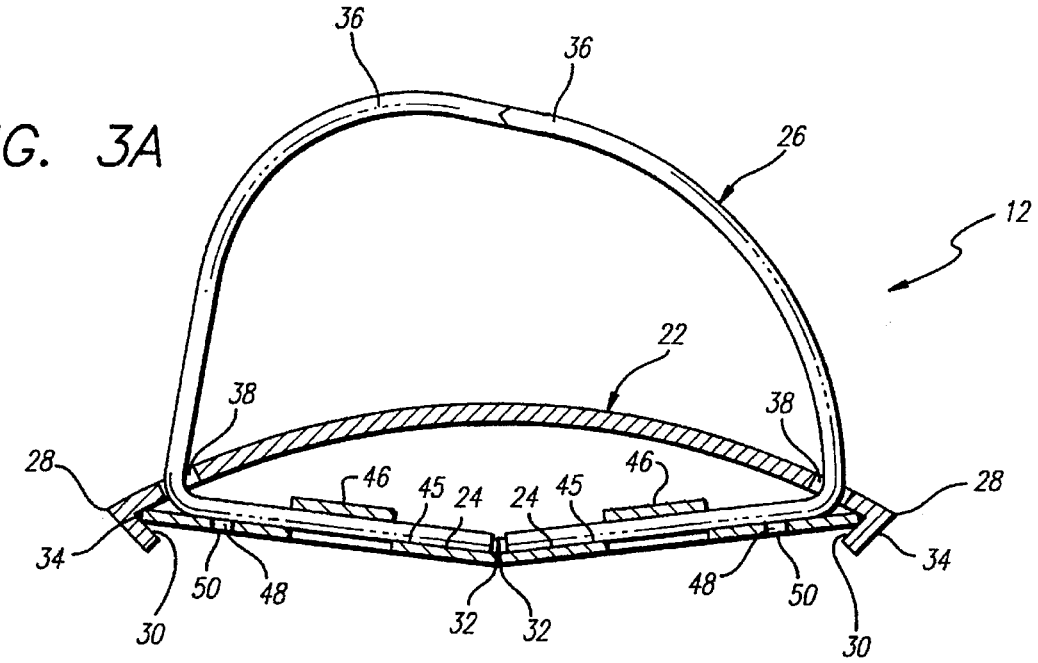
FIG. 3A is a cross-sectional view of the upright and closed binding portion taken along line 3A—3A of FIG. 3.

The toggling plates 24 having a transverse distance between the outer longitudinal edges 34 thereof when the toggling plates 24 are coplanar with each other. The transverse distance between the outer longitudinal edges 34 of the toggling plates 24 is slightly greater than the transverse distance between the longitudinal channels 30 of the cover plate 22. Therefore, the cover plate 22 urges the outer longitudinal edges 34 of the toggling plates 24 together with the inner longitudinal edges 32 of the toggling plates 24 positioned either above the coplanar position, as shown in FIG. 4A, or below the coplanar position, as shown in FIG. 3A, which toggling effect will be discussed in more detail below.

Each of the rings 26 is formed by a pair of ring portions 36. One of the ring portions 36 of each of the rings 26 is pivotally attached to one of the toggling plates 24, and the other ring portion 36 of each of the rings 26 is pivotally attached to the other toggling plate 24. The cover plate 22 may have a corresponding plurality of pairs of apertures 38 through which the ring portions 36 are received to attach to the plates 24. The apertures 38 facilitate or enable the rings 26 to be collapsed to a greater degree against the cover plate 22, thereby lessening an acute angle defined between the rings 26 and the cover plate 22. To decrease the acute angle even more, grooves configured complementarily to the rings 26 may be formed in the top of the cover plate 22 for receiving the rings 26 therein; accordingly, the rings 26 may be substantially flush with the top surface of the cover plate 22 when in the collapsed position. The ring portions 36 are pivotally mounted to the toggling or pivoting assembly such that as the pivoting assembly pivots, the ring portions 36 correspondingly open and close with respect to each other, which will be discussed in more detail below.

The rings 26 are pivotal from the collapsed position to an upright position. When in the collapsed position, the rings 26 define an acute angle with the cover plate 22 and/or the toggling plates 24. When in the upright position, the rings 26 are substantially perpendicular to the cover plate 22 and/or the toggling plates 24. The rings 26 may be pivoted or toggled between an opened position in which exposed ends of the ring portions 36 are separated (see FIG. 4A) and a closed position in which the ends the ring portions 36 are together (see FIG.3A).

Although the rings 26 are shown in the drawings to be collapsible in one direction (i.e., clockwise), the rings 26 may be collapsible in alternating directions. For example, if there are three rings 26 provided with relatively large diameters, then the uppermost ring when collapsed may extend beyond the edge of the ring binder 10. Therefore, the uppermost ring may be collapsible back toward the middle ring, that is, in a counter-clockwise direction. If the diameter of the rings 26 is very large, then the uppermost and the middle ring may overlap when in the collapsed position. In this ease, the complementarily configured grooves in the cover plate 22 may be particularly beneficial so that the lower of the overlapping rings does not cause the upper of the overlapping rings to define a relatively large acute angle with the toggling assembly. In sum, rings disposed at or near the top or bottom (i.e., at the ends) of the binding assembly may be pivotal in a direction opposite to that of the other rings and may overlap with intermediary rings when collapsed.

The binding assembly 12 preferably includes a pull-tab portion 40 comprising a pull strap 42 releasably attached to each of the rings 26 and a finger ring 44 attached to one end of the pull strap 42. When the rings 26 are in the collapsed position as shown in FIG. 2, the pull tab 40 is pulled in the direction of arrow X, pivoting the rings 26 collectively and simultaneously upward as indicated by arrow Y to be in the upright position as shown in FIG. 3. The pull tab 40 is removable from the rings 26 and may be discarded. The finger ring 44 is attached to the end of the pull strap 42 corresponding to the direction the pull tab 40 needs to be pulled to pivot the rings 26 upwardly into the upright position. Alternatively, a user may pivot the rings 26 individually with a finger.

The pull strap 42 may be detachably attached to the rings 26 (or to one of the ring portions 36) by various methods. For example, the pull strap 42 may have loops through which the rings 26 are receivable. After the rings 26 have been pivoted to the upright position, the rings 26 may be opened, and the pull strip 42 may then be slid off the rings 26. Alternative structure may also detachably attach the pull strip 42 to the rings 26, such as perforations or adhesives.

Figure 6:
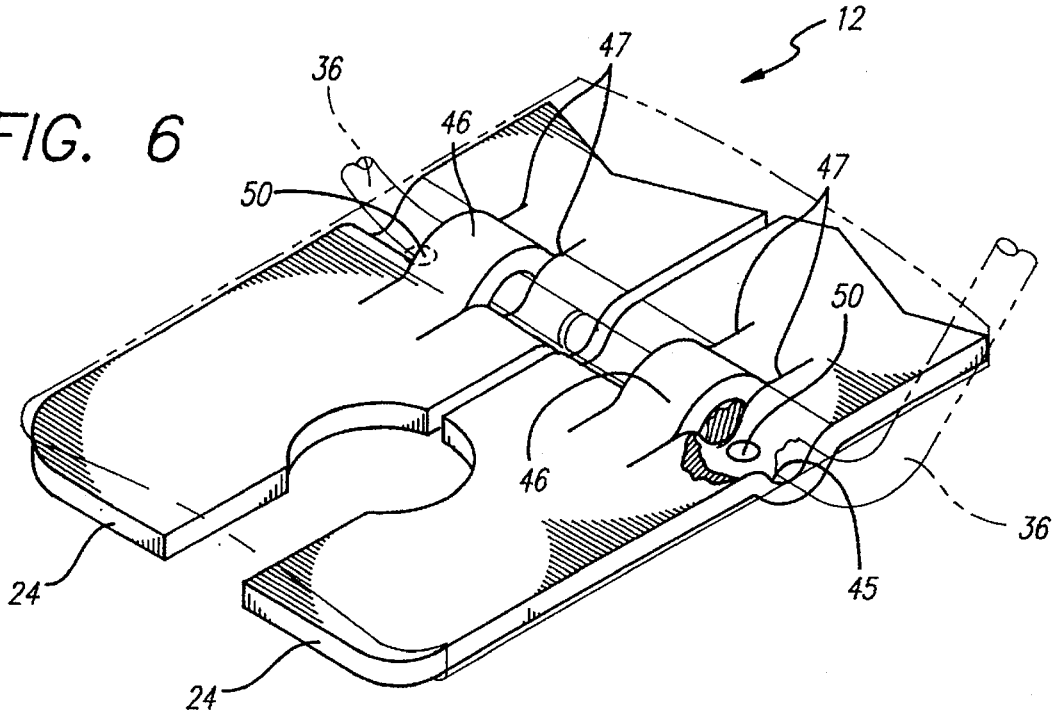
FIG. 6 is a fragmentary perspective view of the binding portion, particularly showing the pivotal attachment and locking structure of the binding portion in an intermediate position.

As previously mentioned, the rings 26 are pivotally attached to the toggling plates 24 so that the ring binder 10 may be stored when in the rings 26 are in the collapsed position shown in FIG. 2 and may be used to retain paper or the like when the rings 26 are in the upright position shown in FIGS. 3 and 4. With additional reference to FIGS. 5, 6, and 7, the rings 26 are pivotally attached to the toggling plates 24 by pivotal attachment structure which preferably takes the form of a trough 45 and a retaining strap 46. Each of the toggling or pivoting plates 24 has a plurality of troughs 45 and retaining straps 46 formed thereon to correspond to the plurality of rings 26.

The troughs 46 and the retaining straps 46 may be formed by cutting through the toggling plates 24 to form pairs of longitudinally extending cuts 47. The toggling plates 24 may then be crimped in substantially equal distances with the retaining straps 46 curving upward and the troughs 45 curving downward. One of the ring portions 36 is then rotatably receivable in each of the troughs 45 with the corresponding retaining strap 46 retaining the ring portion 36 in the trough 45. The cutting of the longitudinal cuts 47 in the toggling plates 24 may be accomplished by stamping or according to any metal-forming method known in the art.

Although only one retaining strap 46 is shown formed in the toggling plate 24 for each ring portion 36, two or more retaining straps 46 may be formed to retain the ring portion 36 in the trough 45. Further, the retaining straps 46 may be formed by other methods, for example, welding strap pieces, but the longitudinally extending cuts 47 are preferable because of cost-effective manufacturing benefits. Also, the troughs 45 may be in the form of grooves or arcuate indentations machined into the toggling plates 24 so that the bottom surfaces of the toggling plates 24 are planar. The toggling plates 24 with the retaining straps 46 and the troughs 45 may be formed on one processing line, and do not need additional processing steps. This reduces the cost of manufacturing the binding assembly 12.

For most users, once the ring binder 10 according to the present invention is purchased and put into use with the rings 26 stabilized and secured in the upright position, the user may not need to collapse the rings 26 to store ring binder 10. Accordingly, it is preferable for the binding assembly 12 to incorporate a securing or locking mechanism to lock the rings 26 permanently in the upright position. Alternatively, the locking mechanism could also releasably lock the rings 26 in the upright position if the user foresees or desires the need to collapse and store the ring binder 10 after some time of use. This semipermanent upright locking of the rings 26 may also be desirable to sales people who want to demonstrate the ring binder of the present invention by pivoting the rings 26 into the upright position and then collapsing the rings 26 again for future demonstrations.

Figure 2A:
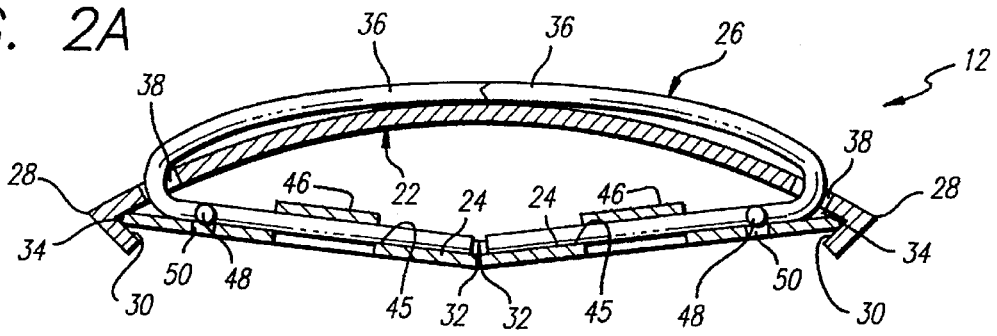
FIG. 2A is a cross-sectional view of the collapsed binding portion taken along line 2A—2A of FIG. 2.
Figure 7:
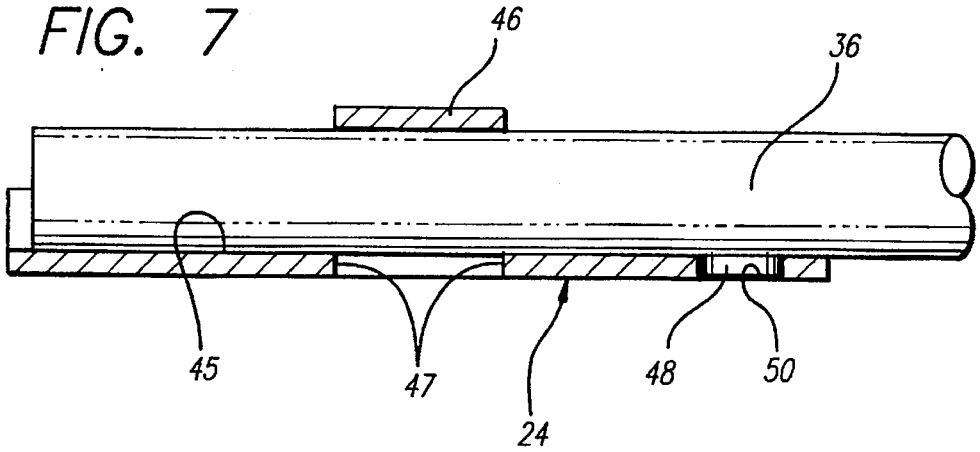
FIG. 7 is a fragmentary cross-sectional view of the binding portion, particularly showing the pivotal attachment and locking structure of the binding portion in the locked and upright position.

A ring-locking mechanism of the invention preferably includes a raised surface or boss 48 formed on each of the ring portions 36 and a hole 50 formed in each of the troughs 45 of the toggling plates 24. Each of the bosses 48 is positioned on the corresponding ring portion 36 so that when the rings 26 are in the collapsed position, the bosses 48 are not respectively received in the holes 50, as shown in FIG. 2A. However, when the rings 26 are pivoted into the upright position, each of the bosses 48 rotates toward the corresponding hole 50 and "snaps" into the hole 50 when the rings 26 are substantially perpendicular to the longitudinal axis of the toggling plates 24 or cover plate 22, as shown in FIGS. 3A and 7. This snapping action results from the natural resiliency of the metal comprising the ring portions 36 and/or the toggling plates 24. Accordingly, when the rings 26 are in the upright position, each of the bosses 48 may be permanently received in a corresponding hole 50. As mentioned above, in an alternative embodiment of the ring binder 10, the bosses 48 may be, for example, spring loaded so that a user may urge the bosses 48 out of the holes 50 if the user desires to collapse the rings 26 after placing the rings 26 in the upright position.

In an alternative embodiment of the locking mechanism, each of the ring portions 36 may have a flat side and each of the troughs 45 may have a complementary flat portion which bears against the flat side of the ring portions 36 when the rings 26 are in the upright position, thereby stabilizing and securing the rings 26 in the upright position. In this embodiment, the manufacturing of the binding assembly is simplified as the complementary flat sides are easily formed at the same time the ring portions 36 and the troughs 45 are formed and do not require an additional manufacturing step. Also, the flat side may be configured to allow the rings 26 to be pivotal back and forth between the collapsed position and the upright position.

In view of the foregoing description, the ring binder 10 implemented in accordance with the principles of the present invention occupies relatively little storage space, as shown in FIG. 1, when the rings 26 are in the collapsed position so that more ring binders 10 may be packed in a given box for shipping and storage or placed on a shelf for sale. Therefore, costs associated with packing, shipping, storage, inventory, sales (e.g., shelf space), and so on are substantially reduced. To place the ring binder 10 into operation, a user pivots the rings 26 from the collapsed position to the upright position shown in FIGS. 3 and 3A. The upward pivoting may be facilitated by providing the pull strap 40 so that all the rings 26 may be pivoted collectively and simultaneously. As shown in FIGS. 3 and 3A, the rings 26 are in the closed position and retained in the upright position by the provision of the locking mechanism of the bosses 48 and corresponding holes 50. Paper or the like may be retained by the rings 26 by pivoting or toggling the rings 26 into the open position shown in FIGS. 4 and 4A. The cover plate 22 limits the range the toggling plates 24 may pivot, as clearly shown in FIG. 4A. The rings 26 may be toggled or pivoted back to the closed position with the exposed ends of the ring portions 36 abutting, thereby limiting the range the toggling plates 24 may pivot.

Regarding the space-saving characteristics of the ring binder 10 of the present invention, the overall thickness of the ring binder 10 is preferably decreased by at least 50 percent when the rings 26 are in the collapsed position as opposed to the upright position. However, as the diameter of the rings 26 increases, the greater the space-saving benefits. For example, if the rings 26 are approximately 5 inches in diameter, then the ring binder 10 may have an overall thickness of about ½ inch to ¾ inch in the collapsed position and may have an overall thickness of about 5¼ inches to 5½ inches in the upright position. This results in an approximately 85 percent to 90 percent difference in the overall thickness of the ring binder 10. In other words, the ring binder 10 in the collapsed position is about 8½ times smaller than the ring binder 10 in the upright position. In terms of packing density for this example, at least eight 5-inch diameter ring binders 10 of the present invention occupy the same amount of space that one conventional non-collapsible 5-inch ring binder occupies.

Regarding varying diameters of the rings 26 versus the saving in space, the thickness of the ring binder 10 in the collapsed position will not vary greatly depending upon the diameter of the rings 26; that is, the thickness of the ring binder 10 in the collapsed position is to a large extent only dependent upon the individual thicknesses of the cover portion, the cover plate 22, and the diameter of the metal comprising the ring portions 36 themselves. Therefore, neither these thicknesses nor the overall collapsed thickness of the ring binder 10 will change significantly as the diameter of the rings 26 increases.

However, the thickness of the ring binder 10 in the upright position will vary proportionally to the diameter of the rings 26. Therefore, the percent difference between the thickness of the ring binder 10 in the upright and collapsed positions increases proportionally with increases in ring diameter. For example, if the ring binder 10 has 1-inch diameter rings 26, then there may be an upright/collapsed difference in thickness of about 55 percent; if the ring binder has 2-inch diameter rings 26, then the difference may be about 75 percent; and if the ring binder 10 has 3-inch diameter rings 26, then the difference may be about 80 percent.

Regarding the acute angle defined between the rings 26 and the toggling assembly when in the collapsed position, it is preferable to configure the toggling assembly, including the cover plate 22 and the toggling plates 24, so that the rings 26 are able to collapse substantially flush with the cover plate 22. Therefore, the acute angle is at least less than about 20 degrees but is preferably less than about 15 degrees. In a number of preferred embodiments, the acute angle may be as small as 5 degrees or less. If complementarily configured grooves are formed in the cover plate 22 as mentioned above, the acute angle may be substantially eliminated.

Numerous modifications and alternatives of the ring binder 10 and the binding assembly 12 within the scope of the present invention are possible. For example, with reference to FIG. 8, another exemplary embodiment of a binding assembly 52 implemented in accordance to the principles of the present invention is illustrated. The binding assembly 52 includes a toggling assembly 54 and a plurality of rings 55 pivotally attached thereto.

The toggling assembly 54 includes a pair of plates, an upper plate 56 and a lower plate 58, forming a sandwich structure. Each of the plates 56 and 58 is formed of two longitudinal halves which are cooperatively and pivotally coupled together along inner longitudinal edges thereof to form a toggle or pivot joint 60. The upper plate 56 and the lower plate 58 are coupled together at tension joints 62.

The tension joints 62 may be stamped-in-place deflecting members, cut from the upper and lower plates 56 and 58 and rotated, so that the plates 56 and 58 are urged to pivot in one direction or the other from the coplanar position of the toggling assembly 54. Accordingly, the tension joints 62 (like the cover plate 22 in the embodiment described above) effect over-center snapping action as the plates 56 and 58 pivot through a coplanar position along the pivot joint 60. Further, the upper plate 56 and the lower plate 58 may be made from metal plates having different thicknesses to enhance the effect of the tension joints 62. The plates 56 and 58 may also be spot welded together. In constructing the toggling assembly 54 in this manner, strict tolerances in the manufacturing process may be lessened, thereby reducing the manufacturing costs associated with this embodiment.

The upper plate 56 and the lower plate 58 are complementarily crimped to form a plurality of pairs of cylindrical cavities 64 corresponding to the plurality of rings 55. One of the cylindrical cavities 64 of the pairs of cavities is formed in one of the longitudinal halves of the upper and lower plates 56 and 58, and the other cylindrical cavity 64 of the pairs of cavities is formed in the other longitudinal half of the upper and lower plates 56 and 58. Each of the rings 55 includes two ring portions 66. One of the ring portions 66 of each of the rings 55 is pivotally received within one of the cylindrical cavities 64, and the other ring portion 66 of the ring 55 is pivotally received within the corresponding other cylindrical cavity 64.

Analogous to the embodiment described above, the rings 55 are pivotal from a collapsed position in which the rings 56 define an acute angle with the toggling assembly 54 (not shown in FIG. 8) to an upright position in which the rings 55 are substantially perpendicular with the toggling assembly 54. The plurality of rings 55 toggle or pivot between an open position in which ends the ring portions 66 are apart (not shown) and a closed position in which the ends of the ring portions 66 are together. Locking structure analogous to that described above may be provided to lock the rings 26 in the upright position either semipermanently or permanently.

Figure 9:
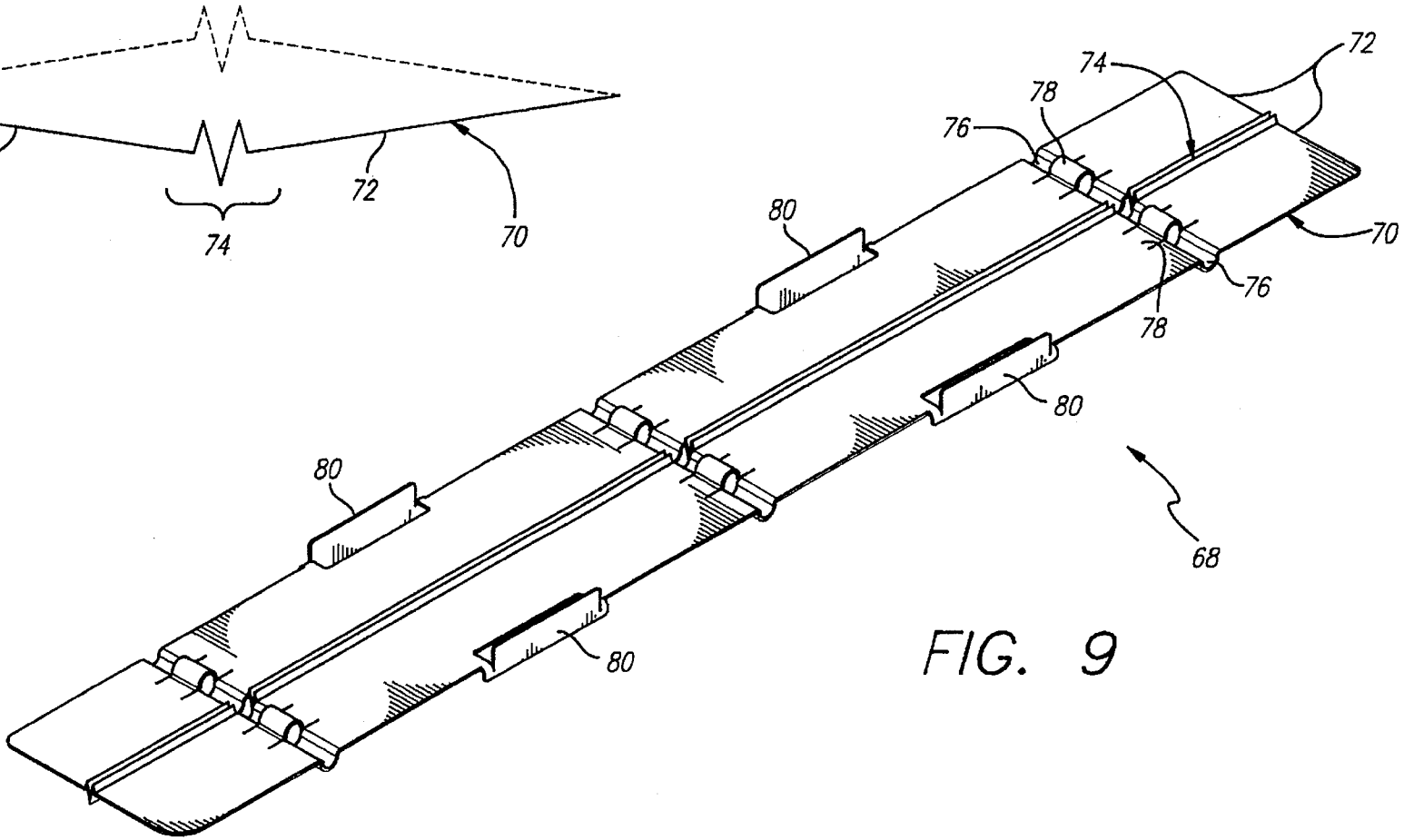
FIG. 9 is a perspective view of a binding portion of a ring binder in accordance with yet another exemplary embodiment of the present invention.

With reference to FIG. 9, a further exemplary embodiment of a toggling assembly 68 is illustrated. The toggling assembly 68 includes a toggling plate 70 which is comprised of two longitudinal halves 72 cooperatively coupled together along inner longitudinal edges thereof to form a toggling joint 74. The toggling plate 70 is cut and crimped as described above in relation to FIGS. 5 to 7 to form a plurality of troughs 76 and retaining straps 78 for rotatably retaining a plurality of rings (not shown). A plurality of stamped-in-place deflecting members 80 are formed along outside longitudinal edges of the toggling plate 70 for spring loading the toggling assembly 74. The stamped-in-place deflecting members 80 effectively absorb tolerances in manufacturing the toggling assembly 68 so that right manufacturing tolerances and controls do not have to be adhered to strictly.

Figure 10:
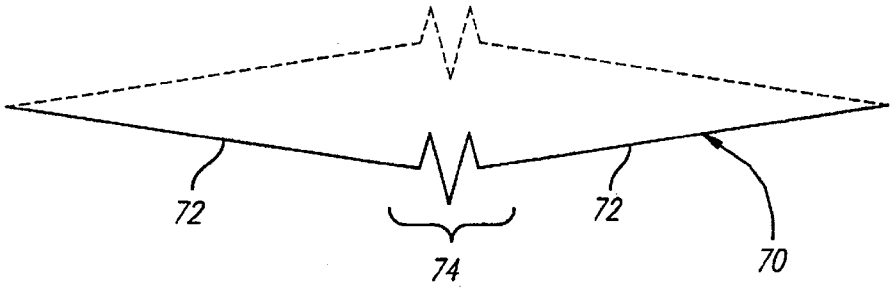
FIG. 10 is a schematic cross-sectional view of a toggling assembly of a binding portion according to a further exemplary embodiment of the present invention.

With additional reference to FIG. 10, the toggling plate 70 may be a singular resilient plate with the toggling joint 74 in the form of an accordion-like fold. Accordingly, as the toggling plate 70 toggles or pivots between an open and closed position (for the plurality of rings which are not shown), the accordion folds of the toggling joint 74 accommodate the contraction and expansion of the longitudinal halves 72 of the toggling plate 70. That is, the toggling joint 74 compresses together as the longitudinal halves 72 approach a coplanar position and expands apart as the longitudinal halves 72 move from the coplanar position.

Figure 8:
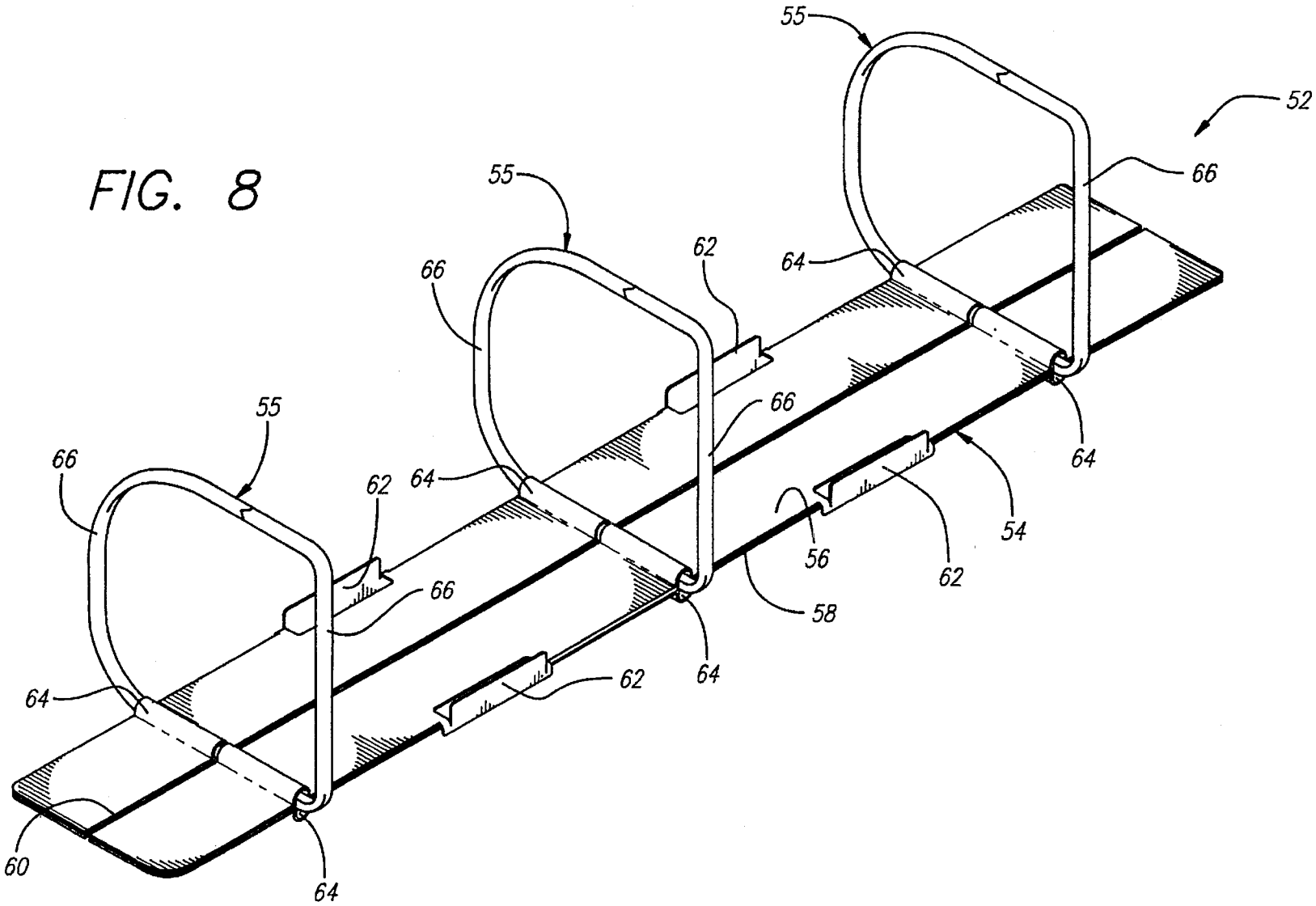
FIG. 8 is a perspective view of a binding portion of a ring binder in accordance with another exemplary embodiment of the present invention.

Concerning the embodiments of FIGS. 8 and 9, the toggling plate (54 and 56 of FIG. 8 and 70 of FIG. 9) may form the lower plates 24 of FIG. 3A with the central pivot being the accordion fold 74 and with a cover plate such as that shown at reference numeral 22 in FIG. 3A. Alternatively, the tabs or tension joints 62 in FIG. 8 or 80 in FIG. 9 may be resiliently mounted to the spine 18 (see FIG. 1) of the binder 10, either directly or through integral or separate mounting arms, spaced apart by a distance slightly less than the coplanar width of the toggle plate(s) 56 and 58 of FIG. 8 or 72 of FIG. 9. With this arrangement, over-center snapping action may be achieved without a cover plate such as plate 22 in FIG. 3A.

In view of the foregoing description of the exemplary embodiments of the invention, a specific commercial embodiment of the ring binder 10 may be manufactured according to any desired specification, to which numerous modifications and alternatives are possible. For example, the front or back cover 14 or 16, along with the spine 18, may be articulated as is known in the art of large-ringed binders to facilitate the accommodation of large amounts of paper. That is, the cover portion may have more than two longitudinal hinge lines about which the covers 14 and 16 may pivot. Further, one of the ring portions 36 of the rings 26 may be substantially flat, typically the ring portion 36 on the right side, so that paper retained by the rings 26 lays flat when the ring binder 10 is opened and laid flat. Also, the ring portions 36 may be dimensioned substantially the same, i.e., each of the ring portions 36 is a half-ring, or may be unevenly dimensioned as a portion of the total ring 26; for example, one of the ring portions 36 may encompass about 60% of the total ring 26, while the ring portion 36 complementary thereto may encompass about 40% of the total ring 26. The cover plate 22 is preferably made of metal, for example, stainless steel or a chrome-alloy steel, and may be about 0.025 inch to about 0.075 inch thick. The toggling or pivoting assembly, including the toggling plates, and the rings are also preferably made from metal material.

Those skilled in the art will appreciate that the present invention may be embodied in other specific terms without departing from the spirit or the principles of the invention, and although the present invention discloses only specific embodiments thereof, it is to be understood that other variations are contemplated as being within the scope of the present invention. For example, locking means may be provided for the rings 26 so that the rings 26 are locked in the closed position and only able to be opened upon activation of the locking means. Accordingly, the present invention is not limited to the particular embodiments which have been described in detail herein but rather but the scope of the appended claims.

What is claimed is:

1. A ring binder comprising:

a) a cover portion including:

(1) a front cover;

(2) a back cover; and (3) a spine having a pair of longitudinal edges, the front cover being pivotally attached to one of the longitudinal edges of the spine and the back cover being pivotally attached to the other longitudinal edge of the spine;

b) a binder portion attached to the cover portion, the binder portion including:

(1) a pair of longitudinally extending, centrally pivotal toggling plates;

(2) a longitudinally extending resilient cover plate engaging outer edges of the toggling plates for applying inwardly directed force to the toggling plates;

(3) a plurality of paper-retaining rings formed of two ring portions and pivotally secured to the toggling plates to permit full collapsing of the rings against the cover plate in a collapsed position;

(4) means for securing the rings in an upright position.

2. The ring binder of claim 1 wherein the rings define an acute angle with respect to the cover plate when the rings are in the collapsed position;

the acute angle being less than about 15 degrees.

3. The ring binder of claim 1 wherein the binder portion has a thickness when the rings are in the collapsed position and a thickness when the rings are in the upright position;

the thickness of the binder portion when the rings are in the collapsed position being at least 50 percent less than the thickness of the binder portion when the rings are in the upright position.

4. A binding assembly for papers comprising:

a cover portion having a front cover, a back cover, and a spine, the front cover and the back cover being pivotal with respect to the spine; and a binder portion including:

a plurality of rings for retaining paper or the like; and a toggling assembly attached to the cover portion for enabling the rings to toggle between an open position to receive paper and a closed position to retain paper;

the rings being pivotally mounted to the toggling assembly, the rings being pivotal between a collapsed position in which the rings define an acute angle with the toggling assembly and an upright position in which the rings are substantially perpendicular to the toggling assembly.

5. The binding assembly of claim 4 wherein the acute angle is less than about 15 degrees.

6. The binding assembly of claim 4 wherein the binder portion has a thickness when the rings are in the collapsed position and a thickness when the rings are in the upright position;

the thickness of the binder portion when the rings are in the collapsed position being at least 50 percent less than the thickness of the binder portion when the rings are in the upright position.

7. The binding assembly of claim 6 wherein each of the rings has a diameter greater than about 1 inch;

the thickness of the binder portion when the rings are in the collapse position being at least 75 percent less than the thickness of the binder portion when the rings are in the upright position.

8. The binding assembly of claim 4 further comprising a pull-tab releasably attached to each of the rings;

the rings being pivotal from the collapsed position to the upright position collectively by pulling the pull-tab.

9. The binding assembly of claim 8 wherein the pull-tab includes a pull strip releasably attached to each of the rings.

10. The binding assembly of claim 9 further comprising a ring attached to an end of the pull strip;

the end of the pull strip being associated with a direction the pull strip is pulled to pivot the rings from the collapsed position to the upright position.

11. The binding assembly of claim 4 wherein the toggling assembly includes:

a plurality of troughs corresponding to the plurality of rings for rotatably receiving one of the rings therein; and a plurality of retaining straps each for retaining one of the rings in the corresponding trough.

12. The binding assembly of claim 11 wherein the toggling assembly includes a pair of toggling plates;

the troughs and the retaining straps being formed by cutting a pair of cuts in the toggling plates for each of the retaining straps, the toggling plates being crimped downward at the pair of cuts to form the troughs and upward at the pair of cuts to form the retaining straps.

13. The binding assembly of claim 12 wherein each of the rings includes a pair of ring portions;

one of the ring portions being rotatably received in one of the troughs formed in one of the toggling plates and the other of the ring portions being rotatably received in a corresponding one of the troughs in the other of the toggling plates.

14. The binding assembly of claim 11 wherein each of the troughs has a hole formed therein and each of the rings has a boss formed thereon;

each of the bosses being receivable in one of the holes when the rings are in the upright position.

15. The binding assembly of claim 4 wherein the rings are releasably lockable in the upright position.

16. A paper-retaining assembly for ring binders comprising:

a) a pair of longitudinally extending plates centrally pivotal with respect to one another;

b) a longitudinally extending resilient cover plate engaging outer edges of the plates for applying inwardly directed force to the plates;

c) a plurality of paper-retaining rings formed of two ring portions and pivotally secured to the plates to permit full collapsing of the rings against the cover plate; and d) a mechanism for securing the rings in an upright configuration.

17. A binding assembly for a ring binder comprising:

a plurality of rings for retaining paper or the like; and a pivoting assembly for enabling the rings to pivot between an open position in which the rings are able to receive paper and a closed position in which the rings retain paper;

the rings being pivotally mounted to the pivoting assembly, the rings being pivotal between a collapsed position in which the rings define an acute angle with the pivoting assembly and an upright position in which the rings are substantially perpendicular to the pivoting assembly.

18. The binding assembly of claim 17 wherein the acute angle is less than about 15 degrees.

19. The binding assembly of claim 17 wherein the binding assembly has a thickness when the rings are in the collapsed position and a thickness when the rings are in the upright position;

the thickness of the binding assembly when the rings are in the collapsed position being at least 50 percent less than the thickness of the binding assembly when the rings are in the upright position.

20. The binding assembly of claim 17 further comprising a pull strip detachably connected to the plurality of rings;

the plurality of rings being collectively pivotal from the collapsed position to the upright position by pulling the pull-strip.

21. The binding assembly of claim 17 wherein the pivoting assembly comprises:

a pair of longitudinally extending halves cooperatively coupled together along inner edges thereof to form a pivoting joint;

means for effecting over-center snapping action of the pivoting assembly as the longitudinally extending halves pivot through a coplanar position along the pivoting joint.

22. The binding assembly of claim 21 wherein the pivoting joint is in the form of an accordion-like fold.

23. A ring binder assembly comprising:

a cover portion;

a binder portion including:

a pivoting assembly attached to the cover portion; and a plurality of rings each including a pair of ring portions pivotally mounted to the pivoting assembly such that as the pivoting assembly pivots, the ring portions correspondingly open and close with respect to each other;

the rings being pivotal between a collapsed position in which the rings define an acute angle with the pivoting assembly and an upright position in which the rings are substantially perpendicular to the pivoting assembly.

24. The ring binder assembly of claim 23 wherein the pivoting assembly is configured such that the ring portions toggle between an open position and a closed position with respect to each other as the pivoting assembly pivots.

* * * * *